US006176765B1

(12) United States Patent
Li et al.

(10) Patent No.: US 6,176,765 B1
(45) Date of Patent: Jan. 23, 2001

(54) ACCUMULATOR FOR SLURRY SAMPLING

(75) Inventors: Leping Li, Poughkeepsie, NY (US); James A. Gilhooly, Saint Albans, VT (US); Robert B. Lipori, Stamford, CT (US); Clifford O. Morgan, III, Burlington, VT (US); William J. Surovic, Carmel; Cong Wei, Poughkeepsie, both of NY (US)

(73) Assignee: International Business Machines Corporation, Armonk, NY (US)

( * ) Notice: Under 35 U.S.C. 154(b), the term of this patent shall be extended for 0 days.

(21) Appl. No.: 09/250,308

(22) Filed: Feb. 16, 1999

(51) Int. Cl.[7] ..... B24B 29/00

(52) U.S. Cl. ..... 451/56; 451/60; 451/446; 451/447

(58) Field of Search ..... 451/444, 446, 451/447, 60, 56

(56) References Cited

U.S. PATENT DOCUMENTS

| | | | |
|---|---|---|---|
| 3,503,711 | 3/1970 | Skala | 23/232 |
| 3,904,371 | 9/1975 | Neti et al. | 23/232 |

(List continued on next page.)

FOREIGN PATENT DOCUMENTS

| | | | |
|---|---|---|---|
| 3277947 | 12/1991 | (JP) | G01N/21/77 |

OTHER PUBLICATIONS

Biolsi, et al, "An Advanced Endpoint Detection Solution for <1% Open Areas", Solid State Technology, Dec. 1996, p. 59–67.

Economou, et al, "In Situ Monitoring of Etching Uniformity in Plasma Reactors", Solid State Technology, Apr., 1991, p. 107–111.

Roland, et al, "Endpoint Detecting in Plasma Etching", J. Vac. Sci. Technol. A3(3), May/Jun. 1985, p. 631–636.

Park et al, "Real Time Monitoring of NH, Concentration Using Diffusion Scrubber Sampling Technique and Result of Application to the Processing of Chemically Amplified Resists" Jpn. J. Appl. Phys. vol. 34 (1995) pp. 6770–6773 Part 1 No. 12B, Dec., 1995.

Carr, et al, Technical Disclosure Bulletin, "End–Point Detection of Chemical/Mechanical Polishing of Circuitized Multilayer Substrates", YO887–0456, vol. 34 No. 4B, Sep. 1991 p. 406–407.

Carr, et al, Technical Disclosure Bulletin, "End–Point Detection of Chemical/Mechanical Polishing of Thin Film Structures". YO886–0830, vol. 34 No. 4A, Sep. 1994, p. 198–200.

Rutten, Research Disclosure, Endpoint Detection Method for ion Etching of Material Having a Titanium Nitride Underlayer, BU890–0132, Feb. 1991, No. 322, Kenneth Mason Publications Ltd, England.

* cited by examiner

*Primary Examiner*—Joseph J. Hail, III
*Assistant Examiner*—William Hong
(74) *Attorney, Agent, or Firm*—Jay H. Anderson

(57) ABSTRACT

A fluid collection apparatus having an accumulator for contacting a polishing surface of a polishing pad and collecting fluid from the polishing pad, a reservoir for receiving fluid from the accumulator, and a volume maintainer for maintaining a set volume of fluid in the reservoir.

9 Claims, 1 Drawing Sheet

U.S. PATENT DOCUMENTS

| | | | | |
|---|---|---|---|---|
| 4,255,164 | * | 3/1981 | Butzke et al. | 51/295 |
| 4,493,745 | | 1/1985 | Chen et al. | 156/626 |
| 4,512,964 | | 4/1985 | Vayenas | 423/403 |
| 4,784,295 | * | 11/1988 | Holmstrand | 222/148 |
| 4,812,416 | | 3/1989 | Hewig et al. | 437/5 |
| 4,961,834 | | 10/1990 | Kuhn et al. | 204/412 |
| 4,975,141 | | 12/1990 | Greco et al. | 156/626 |
| 5,081,051 | * | 1/1992 | Mattingly et al. | 437/10 |
| 5,234,567 | | 8/1993 | Hobbs et al. | 204/415 |
| 5,242,532 | | 9/1993 | Cain | 156/626 |
| 5,242,882 | | 9/1993 | Campbell | 502/325 |
| 5,256,387 | | 10/1993 | Campbell | 423/392 |
| 5,395,589 | | 3/1995 | Nacson | 422/88 |
| 5,399,234 | | 3/1995 | Yu et al. | 156/636 |
| 5,405,488 | | 4/1995 | Dimitrelis et al. | 156/627 |
| 5,439,551 | | 8/1995 | Meikle et al. | 156/626 |
| 5,559,428 | | 9/1996 | Li et al. | 324/71.5 |
| 5,664,990 | * | 9/1997 | Adams et al. | 451/60 |
| 5,709,593 | * | 1/1998 | Guthrie et al. | 451/287 |
| 5,783,497 | * | 7/1998 | Runnels et al. | 438/747 |
| 5,785,585 | * | 7/1998 | Manfredi et al. | 451/288 |
| 5,791,970 | * | 8/1998 | Yueh | 451/8 |
| 5,830,043 | * | 11/1998 | Aaron et al. | 451/72 |
| 5,885,147 | * | 3/1999 | Kreager et al. | 451/443 |
| 5,916,010 | * | 6/1999 | Varian et al. | 451/38 |

ACCUMULATOR FOR SLURRY SAMPLING

FIELD OF THE INVENTION

This invention is directed to semiconductor processing and more particularly to the collection of slurry from a chemical-mechanical polishing apparatus for sampling.

BACKGROUND OF THE INVENTION

In the semiconductor industry, chemical-mechanical polishing (CMP) is used to remove a portion of a film deposited on a wafer. In a CMP process, a film is selectively removed from a semiconductor wafer by rotating the wafer against a polishing pad (or rotating the pad against the wafer, or both) with a controlled amount of pressure in the presence of a slurry.

Monitoring and controlling the CMP process is difficult, since many different factors influence the polishing rate (e.g. rotation speed, polishing pad wear, chemical reactions between the slurry and the wafer surface, etc.). It is desirable to (1) detect when polishing should be stopped (i.e. when the process endpoint has been reached), (2) detect particles in the slurry which cause scratching, (3) detect chemical species for contamination control, and (4) understand the process chemistry. Such tasks could be performed by in-situ real time (i.e. while the wafer is being polished) slurry sampling and analysis. This requires a robust collection apparatus which is not affected by the slurry chemistry, does not interfere with the polishing, and enables sampling with a rapid response time.

SUMMARY OF THE INVENTION

It is therefore an object of the present invention to provide for a slurry collection system suitable for in-situ real-time slurry sampling and analysis.

Another object of the present invention is to provide for such a slurry collection system which is not affected by the slurry chemistry.

Another object of the present invention is to provide for such a slurry collection system that does not interfere with the polishing process.

Yet another object of the present invention is to provide for such a slurry collection system that enables sampling with a rapid response time.

In accordance with the above listed and other objects, a fluid collection apparatus is provided, which comprises an accumulator for contacting a polishing surface of a polishing pad and collecting fluid from the polishing pad, a reservoir for receiving fluid from the accumulator, and a volume maintainer for maintaining a set volume of fluid in the reservoir.

BRIEF DESCRIPTION OF THE DRAWINGS

These and other features, aspects, and advantages will be more readily apparent and better understood from the following detailed description of the invention, in which.

DESCRIPTION OF THE PREFERRED EMBODIMENT

The present invention is described herein in the context of chemical-mechanical polishing merely as a specific example, and is not meant to limit applicability of the invention to semiconductor technology. Those skilled in the art will understand that the invention is broadly applicable to any process in which it is desirable to have a fluid collection apparatus, comprising an accumulator for contacting a polishing surface of a polishing pad and collecting fluid from the polishing pad, an reservoir for receiving fluid from the accumulator, and a volume maintainer for maintaining a set volume of fluid in the reservoir.

Figure 1:
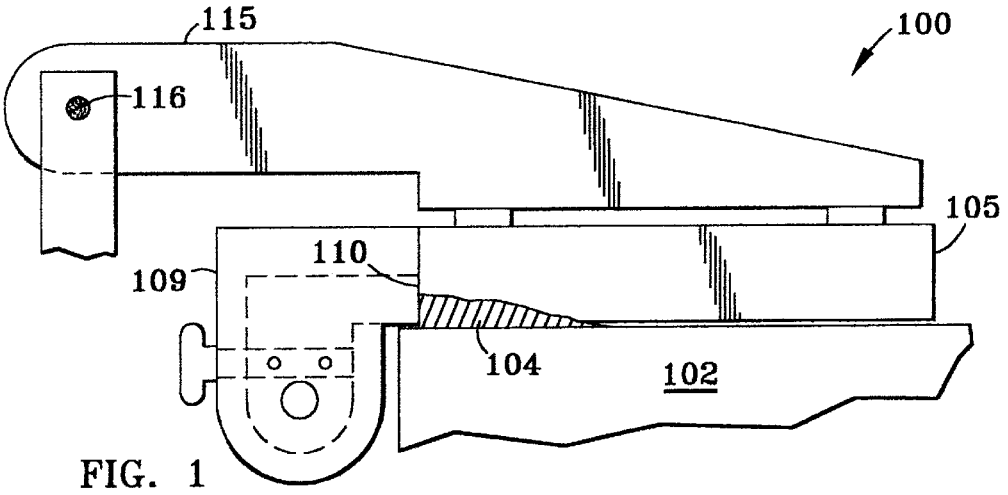
FIG. 1 shows a side view of a slurry accumulator in accordance with the present invention.

FIG. 1 shows a side view of an accumulator 100, which includes a slurry collecting arm 105 positioned in contact with a polishing pad 102 with sufficient downward pressure to squeeze slurry 104 out of pad 102. Accumulator 100 is preferably made of a material which is inert to the polishing slurry, for example stainless steel. The slurry collecting arm 105 may be attached to a bracket 115, which in turn may be secured to the polishing apparatus with a pivot 116. This arrangement permits the accumulator to be swung upward away from the polishing pad 102, so that the accumulator may be moved into a raised position for ease in changing the polishing pad, or for maintenance or the accumulator, the polishing table, or both.

Figure 2:
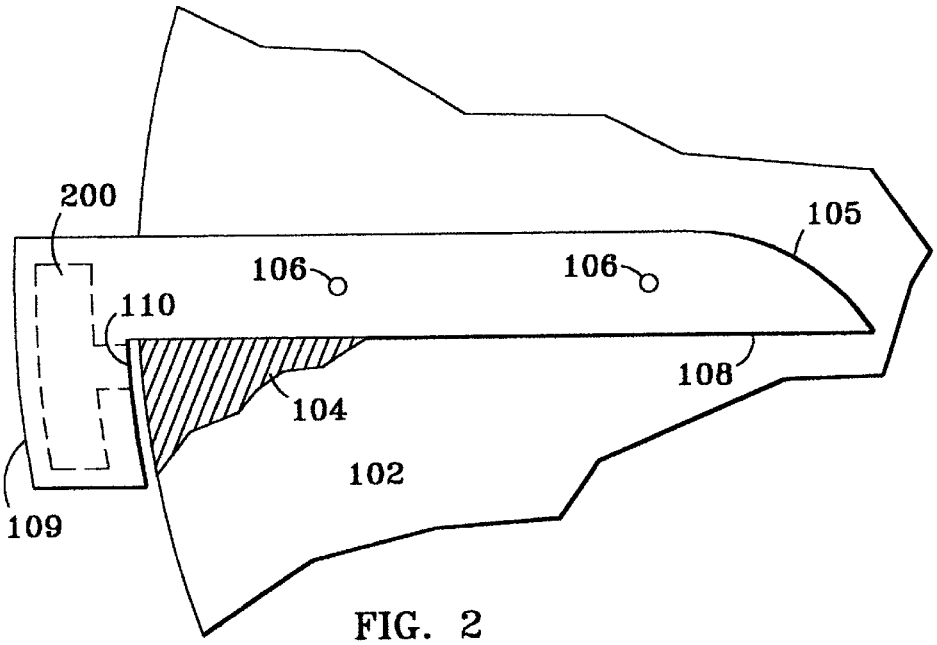
FIG. 2 shows a top view of the slurry accumulator in contact with a polishing pad.

As the polishing pad rotates underneath the accumulator 100, slurry along the leading edge 108 of the slurry collecting arm 105 is guided (by centrifugal force and gravity) into an accumulator section 109 through an opening 110. As shown in FIG. 2, the accumulator section 109 is located at or near the edge of pad 102 and controls loss of the slurry; this also affects the degree of dilution of the slurry to be analyzed.

The downward pressure of the slurry collecting arm 105 on the polishing pad 102 may be adjusted by altering the weight of the slurry collecting arm 105. This may be conveniently done (for example) by providing pins 106 extending upward from the slurry collecting arm, and stacking ring weights on the pins. This arrangement allows for pressure adjustment without disassembly of the apparatus.

Figure 3:
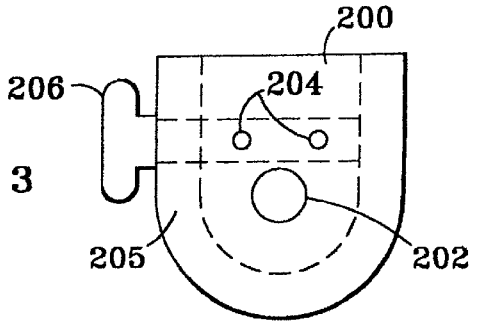
FIG. 3 shows a side view of the slurry reservoir.

The slurry entering the accumulator through opening 110 is guided by centrifugal force and gravity to a reservoir 200, better shown in FIG. 3. In this case, reservoir 200 is integral to accumulator 100, but may also be spaced apart from the accumulator and connected by tubing, and optionally a pump if necessary. Reservoir 200 has an exit hole 202 which is connected to the inlet of a slurry pump (not shown) by inert (e.g. TFE or FEP, also known as Teflon®) tubing.

The amount of slurry in the reservoir is maintained at a given volume by one or more overflow holes 204 above exit hole 202. The overflow can be adjusted using a key 206 which is inserted through the side wall 205 of reservoir 200. Key 206 and holes 204 are designed so that when the key is fully inserted, holes 204 are completely blocked, and when the key is withdrawn, holes 204 are completely open. Accordingly, overflow holes 204 may be closed, partially opened or fully opened, depending on the position of key 206. The proper position of key 206 should be determined experimentally for a given polishing setup. Ideally, the amount of slurry in the reservoir should be controlled so that all of the slurry in the reservoir is collected during the immediately previous rotation of the polishing pad, and is composed of slurry actually used to polish the wafer.

Slurry from reservoir 200 is pumped out of exit hole 202 to a sampling unit (not shown) to perform the type of detection desired, which may be for example extraction of gas molecules from the slurry or particle analysis.

In summary, a slurry collection system for use in an in-situ real-time slurry sampling and analysis has been described, which is not affected by the slurry chemistry, does not interfere with the polishing process, and that enables sampling with a rapid response time.

While the invention has been described in terms of specific embodiments, it is evident in view of the foregoing description that numerous alternatives, modifications and variations will be apparent to those skilled in the art. Thus, the invention is intended to encompass all such alternatives, modifications and variations which fall within the scope and spirit of the invention and the appended claims.

What is claimed is:

1. A fluid collection apparatus, comprising:

an accumulator for contacting a polishing surface of a polishing pad and collecting fluid from the polishing pad, the accumulator including a first portion overlying and in contact with the polishing surface, and a second portion at or near the edge of the polishing pad for controlling the amount of fluid to be accumulated, the weight of the accumulator being adjustable;

a reservoir for receiving fluid from the accumulator; and a volume maintainer for maintaining a set volume of fluid in the reservoir.

2. The apparatus of claim 1 wherein the accumulator is of sufficient weight to compress the polishing pad for the fluid collection.

3. The apparatus of claim 1 wherein the reservoir is integral to the accumulator.

4. The apparatus of claim 1 wherein the reservoir is separate from the accumulator.

5. The apparatus of claim 1 wherein the volume maintainer comprises an overflow hole.

6. The apparatus of claim 5 wherein the volume maintainer further comprises an adjuster for adjusting the size of the overflow hole.

7. A method of fluid collection, comprising the steps of:

contacting a polishing surface of a polishing pad with an accumulator;

compressing the polishing pad by the weight of the accumulator;

collecting fluid from the polishing pad;

adjusting the weight of the accumulator to control the amount of fluid collected in said collecting step;

receiving fluid from the accumulator to a reservoir; and maintaining a set volume of fluid in the reservoir.

8. The method of claim 7 wherein said maintaining step further comprises maintaining the volume using an overflow hole.

9. The method of claim 8 wherein said maintaining step further comprises adjusting the size of the overflow hole.

* * * * *